US009408454B2

(12) United States Patent
Schmidt et al.

(10) Patent No.: US 9,408,454 B2
(45) Date of Patent: Aug. 9, 2016

(54) PENCIL

(71) Applicant: Schwan-STABILO Cosmetics GmbH & Co. KG, Heroldsberg (DE)

(72) Inventors: Ralf Schmidt, Rosstal (DE); Andreas Weber, Heroldsberg (DE); Clemens Wiesmann, Heroldsberg (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 119 days.

(21) Appl. No.: 14/074,789

(22) Filed: Nov. 8, 2013

(65) Prior Publication Data

US 2014/0064819 A1 Mar. 6, 2014

Related U.S. Application Data

(62) Division of application No. 12/267,170, filed on Nov. 7, 2008, now Pat. No. 8,596,895.

(30) Foreign Application Priority Data

Nov. 12, 2007 (DE) ..... 20 2007 015 725 U

(51) Int. Cl.

| | |
|---|---|
| ***A45D 40/08*** | (2006.01) |
| ***A45D 40/20*** | (2006.01) |
| ***B43K 21/02*** | (2006.01) |
| ***B43K 23/10*** | (2006.01) |
| ***B43K 24/06*** | (2006.01) |
| ***B43K 29/06*** | (2006.01) |
| ***B43L 23/06*** | (2006.01) |
| ***B43L 23/08*** | (2006.01) |
| ***B43L 23/00*** | (2006.01) |

(52) U.S. Cl.

CPC ..... *A45D 40/08* (2013.01); *A45D 40/20* (2013.01); *B43K 21/02* (2013.01); *B43K 23/10* (2013.01); *B43K 24/06* (2013.01); *B43K 29/06* (2013.01); *B43L 23/00* (2013.01); *B43L 23/06* (2013.01); *B43L 23/08* (2013.01); *A45D 2040/202* (2013.01)

(58) Field of Classification Search

CPC ..... A45D 40/08; B43K 29/06; B43L 23/00; B43L 23/004; B43L 23/06; A45D 2040/202

USPC ..... 401/50, 98

See application file for complete search history.

(56) References Cited

U.S. PATENT DOCUMENTS

| | | | |
|---|---|---|---|
| 419,768 | A | 1/1890 | Haas |
| 1,242,049 | A | 10/1917 | Schlichtinger |
| 2,065,800 | A | 12/1936 | Freeman |
| 2,037,119 | A | 1/1943 | Duany |
| 2,307,119 | A | 1/1943 | Duany |

(Continued)

FOREIGN PATENT DOCUMENTS

| | | |
|---|---|---|
| DE | 196 16 613 | 10/1997 |
| FR | 1014921 | 8/1952 |

(Continued)

*Primary Examiner* — Mark A Laurenzi
*Assistant Examiner* — Bradley Oliver
(74) *Attorney, Agent, or Firm* — Bachman & LaPointe, PC

(57) ABSTRACT

The invention concerns a pencil comprising a lead, a protective cap and a device for shaping the lead in the protective cap. According to the invention it is provided that the shaping device is displaceable axially with respect to the lead when the protective cap is fitted. (FIG. 1)

15 Claims, 4 Drawing Sheets

(56) References Cited

U.S. PATENT DOCUMENTS

| | | | |
|---|---|---|---|
| 2,565,715 | A | 8/1951 | Becker et al. |
| 2,624,316 | A | 1/1953 | Blanco et al. |
| 2,757,638 | A | 8/1956 | Goldstein |
| 3,049,096 | A | 8/1962 | Hampton |
| 3,768,915 | A | 10/1973 | Spatz |
| 4,513,798 | A | 4/1985 | Luettgens |
| 4,755,074 | A | 7/1988 | Roberts |
| 7,143,516 | B2 | 12/2006 | Sterios |
| 2007/0031176 | A1 | 2/2007 | Gieux |
| 2010/0028069 | A1 | 2/2010 | Pahlck et al. |

FOREIGN PATENT DOCUMENTS

| | | |
|---|---|---|
| JP | 63-175517 | 11/1988 |
| JP | 06199093 | 7/1994 |
| JP | 2002-336043 | 11/2002 |

PENCIL

CROSS REFERENCE TO RELATED APPLICATION

This application is a divisional application of application Ser. No. 12/267,170 filed Nov. 7, 2008.

BACKGROUND OF THE INVENTION

The invention concerns a pencil comprising a lead, a protective cap and a device for shaping the lead in the protective cap.

Pencils of the above-indicated kind are known, for example from DE 196 16 613 C1. In accordance therewith the lead is axially displaceable, more specifically by means of a spindle drive. When the protective cap is fitted the lead can be advanced until it reaches the shaping device. As it rotates about its axis in the further advance movement, it can be sharpened by further actuation of the spindle drive, by means of the shaping device. As sharpening is effected by actuation of the spindle drive the advance is fixedly predetermined in the sharpening operation. More specifically it corresponds to the pitch of the spindle used.

The object of the invention is to make the axial movement of the shaping device with respect to the lead individually selectable.

SUMMARY OF THE INVENTION

In accordance with the invention the specified object is attained in that the shaping device is displaceable axially with respect to the lead when the protective cap is fitted.

It is therefore not the lead that is displaced within the pencil with respect to the shaping device, as is the case with the pencil disclosed in DE 196 16 613 C1, but rather conversely the shaping device is displaced with respect to the lead. That means that the axial displacement is no longer coupled to the spindle drive and can be individually selected.

In accordance with the invention the shaping operation can include a sharpening operation and/or a cutting operation. The corresponding tool therefore involves for example a sharpener. It is however also possible to use for example a blade which is pivotable and/or deformable against an elastic return force. Together with that blade it is possible to use a guide template.

So that the shaping device does not always bear against the lead in accordance with a particularly preferred embodiment of the invention there is provided an elastic return force which biases the shaping device into its rest position. The shaping device is therefore urged away from the lead in the non-actuated state.

In accordance with the invention preferably a particularly simple structure is afforded by an elastic device which is pressure-loaded to produce the return force.

In that respect it can involve for example a coil spring.

In accordance with a particularly preferred embodiment of the invention a handle for axial displacement of the shaping device with respect to the lead coincides with a handle for actuation of the shaping device. The shaping device is therefore simultaneously displaced axially in a direction towards the lead and actuated, by means of the handle, for example by rotation. That dual function of the handle simplifies the sharpening procedure.

Preferably in accordance with the invention there is provided a sleeve which receives an end portion of the protective cap and to which the shaping device is coupled for axial displacement and/or for actuation. That sleeve accordingly represents the above-mentioned handle.

Preferably in accordance with the invention the sleeve has a bottom portion for limiting the extent of the displacement of the shaping device with respect to the lead. That ensures, in the case of the sharpener as the shaping device, that excessive sharpening is avoided.

In accordance with a particularly preferred embodiment of the invention there is provided a device for limiting the extent of the displacement of the shaping device with respect to the lead. That limiting device can on the one hand obviate excessive sharpening. It can however also serve to limit excessive displacement of a blade used for shaping the lead.

Preferably in accordance with the invention the shaping device is visible from the outside at least in its working position. That provides that the extent of sharpening is visible during the sharpening operation. The sharpening operation can be concluded when the lead is sufficiently sharp for the respective individual requirements.

In particular to make the shaping device visible from the outside in its working position, a preferred feature of the invention provides that the protective cap is at least portion-wise transparent. That means that the shaping device arranged within the protective cap is visible from the outside.

The pencil can have a cartridge, within which the lead is axially displaceably held. In that way it is possible for example to adjust a protruding length of the pencil out of the cartridge prior to and/or after the sharpening operation.

In that respect in a further preferred feature according to the invention there is provided a rotary drive for displacement of the lead with respect to the cartridge.

BRIEF DESCRIPTION OF THE DRAWINGS

The invention is described in greater detail hereinafter by means of a preferred embodiment with reference to the accompanying drawings in which.

DETAILED DESCRIPTION

Figure 1:
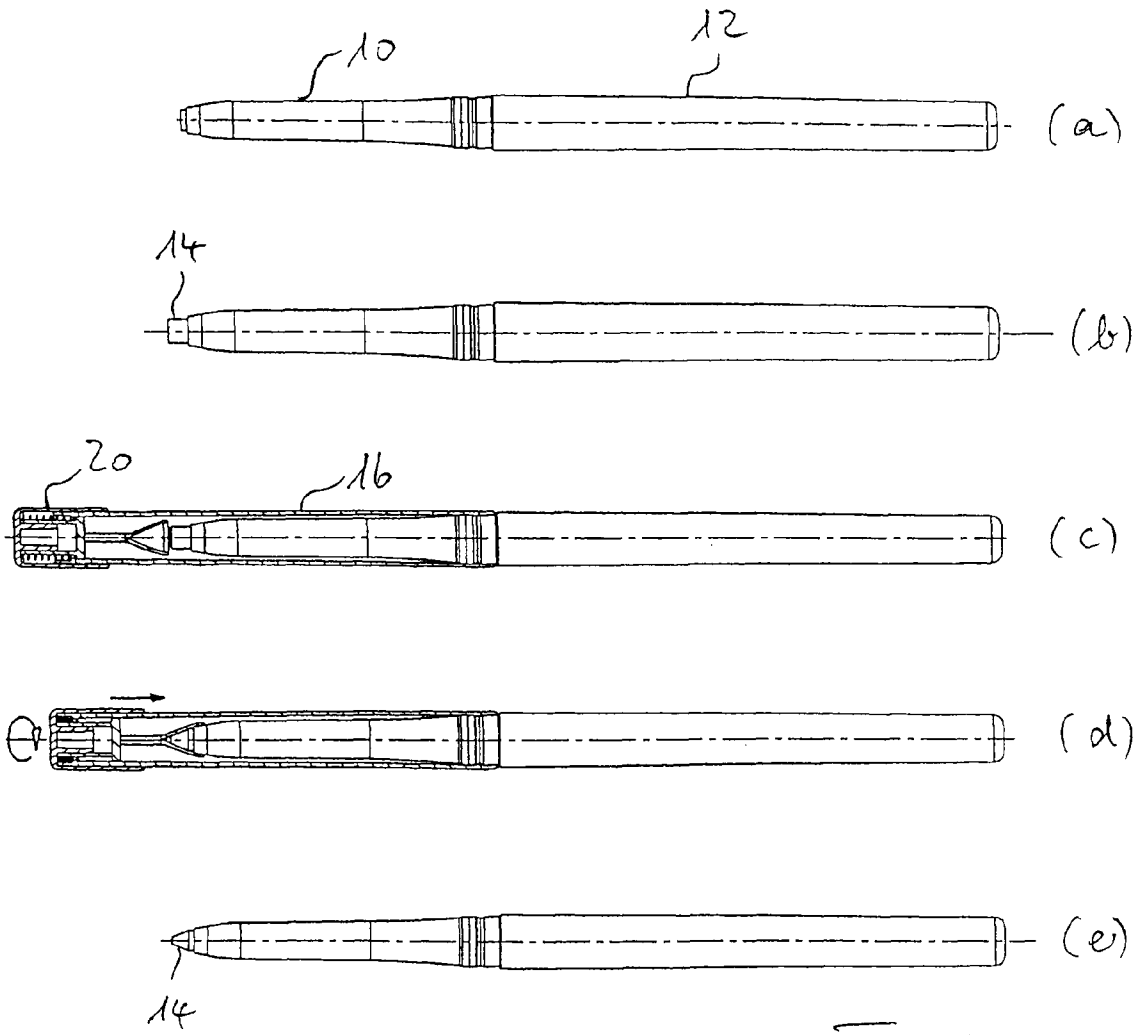
FIGS. 1(*a*) through (*e*) diagrammatically show an embodiment of a pencil according to the invention in various operating conditions, FIGS. 2(*a*) and (*b*) show sectional views on an enlarged scale of FIGS. 1(*c*) and (*d*)
Figure 2:
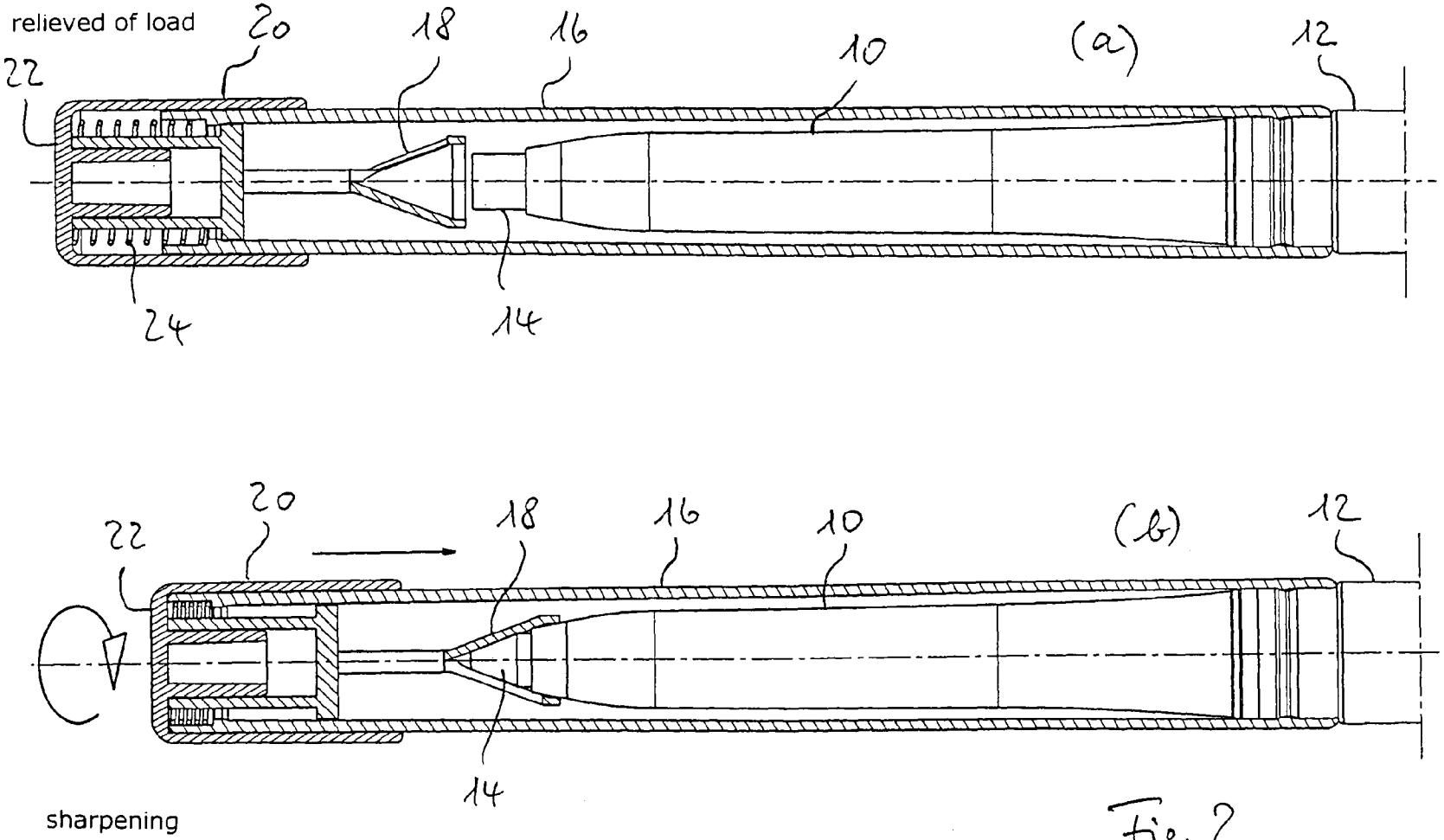

The stick or pencil shown in FIGS. 1 and 2 includes a cartridge 10, a shank 12, a lead 14 and a protective cap 16. A sharpener 18 is held in the protective cap 16. The sharpener 18 is displaceable in the axial direction with respect to the lead 14 by means of a sleeve 20 with a bottom portion 22 against the elastic return force of a coil spring 24.

A rotary drive serves for axial displacement of the lead 14 with respect to the cartridge 10, the rotary drive not being shown in the drawing as it is usual in pencil technology. The rotary drive is actuated by rotation of the shank 12 with respect to the cartridge 10.

The protective cap 16 is made of a transparent material, for example transparent plastic material.

FIG. 1(*a*) shows the pencil with a blunt lead. By actuation of the rotary drive, that is to say by rotation of the shank 12 with respect to the cartridge 10, the lead 14 can be pushed out of the cartridge 10 to the desired projecting length, as shown in FIG. 1(*b*). In that respect the projecting length can be freely selected and can be adjusted by suitable actuation of the rotary drive.

For sharpening the lead 14, the protective cap 16 is fitted on to the cartridge 10 as shown in FIG. 1(*c*) and FIG. 2(*a*). It is supported on the shank 12. In that condition the coil spring 24 is relieved of load to a rest position.

Actual sharpening of the lead 14 is effected by the sleeve 20 being displaced towards the right in the Figures with respect to the protective cap 16 and thus also with respect to the lead 14, and being rotated at latest when the sharpener 18 makes contact with the lead 14. FIG. 1(*d*) and FIG. 2(*b*) show the pencil in an operating condition in which the sleeve 20 and thus the sharpener 18 are displaced towards the right to the maximum with respect to the protective cap 16 and the lead 14 because the bottom portion 22 bears against the protective cap 16. If the sharpener 18 were still further displaceable, the cartridge 10 would be sharpened. The coil spring 24 is stressed to the maximum in that operating condition. It therefore biases the sharpener 18 into its rest position as shown in FIG. 1(*c*) and FIG. 2(*a*).

The sharpener 18 and the lead 14 are visible throughout because of the transparency of the protective cap 16, that is to say during the actual sharpening operation.

Figure 3:
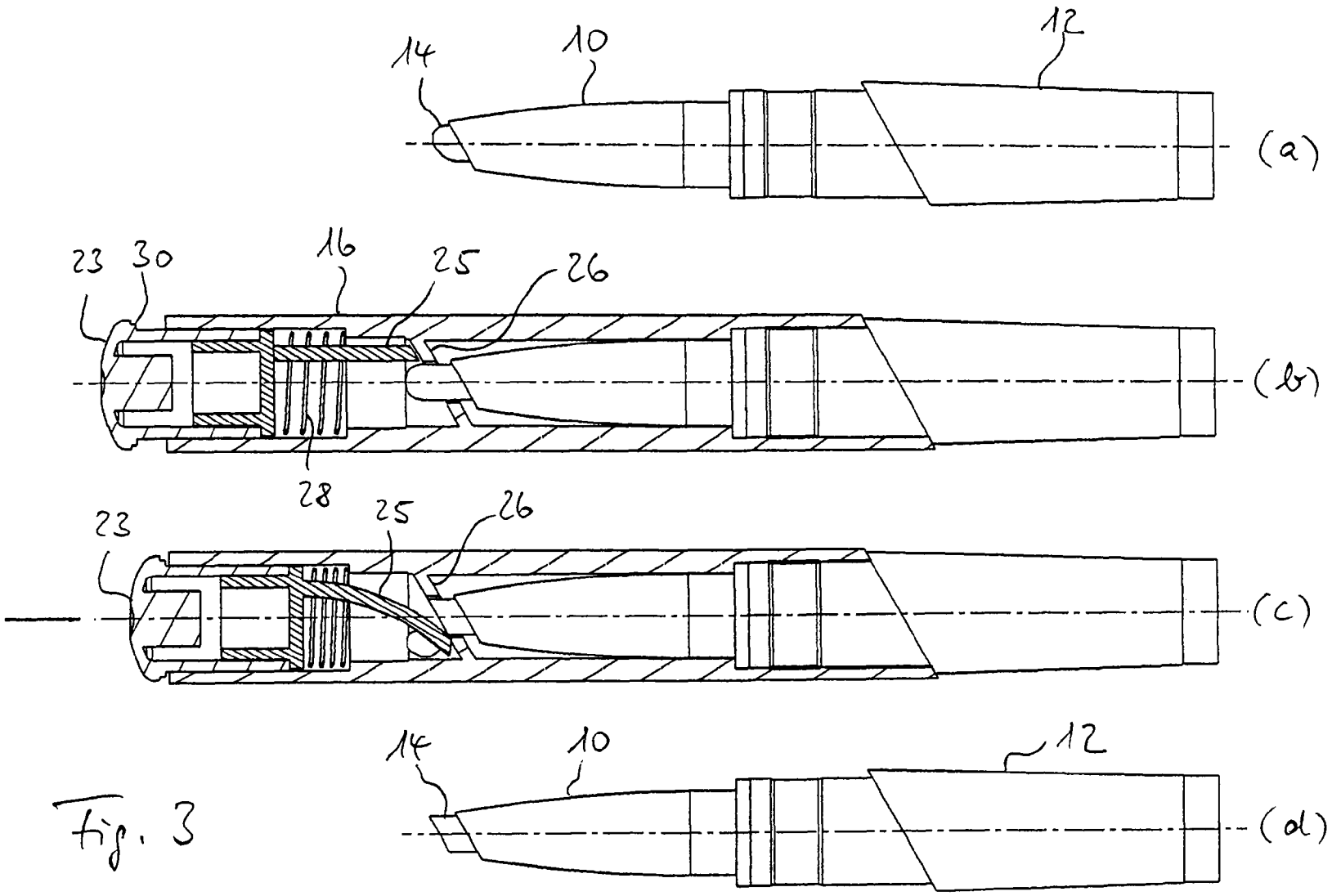
FIGS. 3 and 4 show similar views to FIGS. 1 and 2 but of another embodiment.

The embodiment of FIGS. 3 and 4 functions as follows:

FIG. 3(*a*) shows the pencil with a blunt lead 14. Firstly the lead is advanced by means of a rotary mechanism (not shown) so that the length by which the lead 14 protrudes from the cartridge 10 is increased. The protective cap 16 is then fitted. That rest condition is shown in FIG. 3(*b*) and FIG. 4(*b*).

When a knob 23 is depressed in that operating position a blade 25 slides along a guide template 26 and cuts off the lead 14. The knob 23 is displaceable axially against the elastic return force of a coil spring 28 to cut off the lead 14, until it encounters an abutment 30 on the protective cap 16 to limit the extent of the displacement. That condition is shown in FIG. 3(*c*) and FIG. 4(*a*).

After that the protective cap 16 is removed again. The pencil is now in the operating condition shown in FIG. 3(*d*) which differs from that shown in FIG. 3(*a*) only in that the lead 14 is sharpened by being cut off.

Once again therefore it is to be noted that in the second embodiment also the blade 25 serving as the shaping device is axially displaceable independently of the lead 14.

Figure 4:
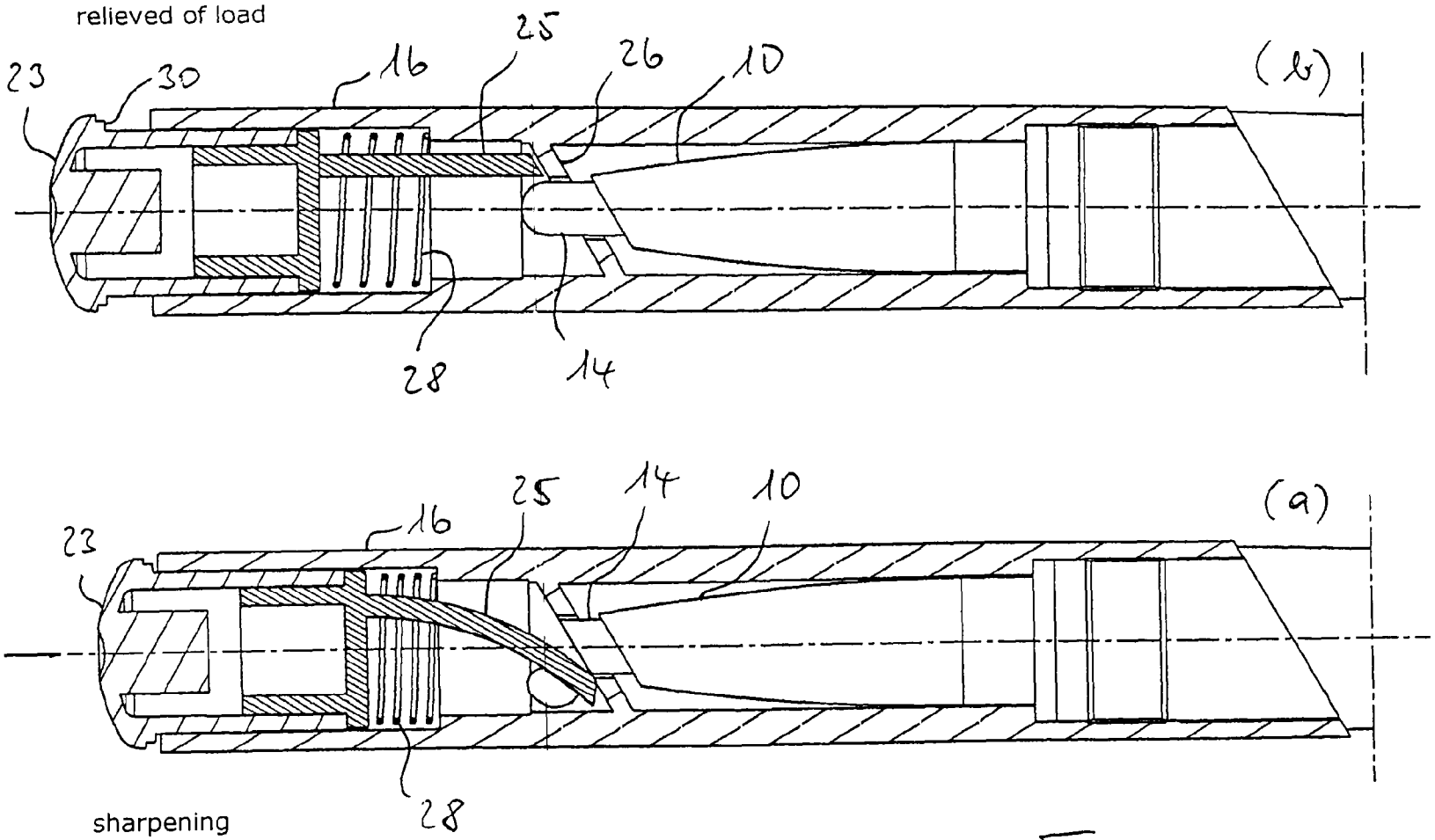

Flexing of the blade 25 as shown in FIG. 3(*c*) and FIG. 4(*a*) takes place against an elastic return force so that, after release of the knob 23 and the return movement thereof by the spring 28, the blade 25 again assumes the rest position or shape shown in FIG. 3(*b*) and FIG. 4(*b*) respectively.

The features of the invention disclosed in the foregoing description, the claims and the drawing can be essential both individually and also in any combinations for implementing the invention in its various embodiments.

Points of explanation relating to FIG. 1:

(a) blunt lead
(b) pre-rotating the lead to the sharpening length
(c) fitting the protective cap
(d) rotating the sharpener and in so doing pressing it lightly against the tip
(e) pointed lead ready for makeup

The invention claimed is:

1. A pencil comprising:
a lead;
a protective cap;
a device for shaping the lead in the protective cap;
a knob which fits into an end portion of the protective cap and to which the shaping device is coupled for axial displacement and/or for actuation,
the shaping device is displaceable axially with respect to the lead when the protective cap is fitted on the pencil and further including means for providing an elastic return force which biases the shaping device away from the lead into a rest position.

2. A pencil as set forth in claim 1 wherein the shaping device includes means for cutting a leading edge of the lead.

3. A pencil as set forth in claim 1 wherein the means comprises an elastic device which is pressure-loaded for producing the return force.

4. A pencil as set forth in claim 1 wherein the means comprises a coil spring for producing the elastic return force.

5. A pencil as set forth in claim 1 wherein action of the knob to cause axial displacement of the shaping device also causes actuation of the shaping device.

6. A pencil as set forth in claim 1 further including a device for limiting displacement of the shaping device with respect to the lead.

7. A pencil as set forth in claim 1 wherein the shaping device is visible from the outside at least in its working position.

8. A pencil as set forth in claim 7 wherein the protective cap is at least portion-wise transparent.

9. A pencil as set forth in claim 1 further including a cartridge wherein the lead is axially displaceably held.

10. A pencil as set forth in claim 9 further including a rotary drive for displacement of the lead with respect to the cartridge.

11. A pencil as set forth in claim 1, wherein the knob and the shaping device are axially displaceable relative to the protective cap.

12. A pencil as set forth in claim 1, wherein the rest position is defined by the shaping device being axially spaced away from the lead, and wherein the shaping device is displaceable axially from the rest position, toward the lead, and against the elastic return force.

13. A pencil comprising:
a lead;
a protective cap;
a device for shaping the lead in the protective cap;
a knob which fits into an end portion of the protective cap and to which the shaping device is coupled for axial displacement and/or for actuation,
wherein the shaping device is displaceable axially with respect to the lead when the protective cap is fitted on the pencil, and a spring biases the knob away from the lead to a rest position.

14. A pencil as set forth in claim 13, wherein the rest position is defined by the shaping device being axially spaced away from the lead, and wherein the shaping device is displaceable axially from the rest position, toward the lead, and against the elastic return force.

15. A pencil comprising:
a lead;
a protective cap;
a device for shaping the lead in the protective cap;
a knob which fits into an end portion of the protective cap and to which the shaping device is coupled for axial displacement and/or for actuation,
the shaping device is displaceable axially with respect to the lead when the protective cap is fitted on the pencil, the shaping device includes a blade for cutting a leading edge of the lead displacement for shaping the lead.

* * * * *